United States Patent [19]

Cole et al.

[11] 4,426,072

[45] Jan. 17, 1984

[54] GLUE APPLICATION SYSTEM FOR A COLLATING MACHINE

[75] Inventors: Robert C. Cole; Richard A. Gaspar, both of Centerville; Donald C. Stackhouse, Vandalia; John L. Trentman, Tipp City, all of Ohio

[73] Assignee: Harris Corporation, Melbourne, Fla.

[21] Appl. No.: 259,120

[22] Filed: Apr. 30, 1981

[51] Int. Cl.[3] ..... B42B 2/00; B05C 3/02

[52] U.S. Cl. ..... 270/53; 118/411; 118/DIG. 21; 270/37

[58] Field of Search ..... 270/37, 53; 118/411, 118/412, 313–314, 211, 206, 221, 405, 401, DIG. 21; 156/219, 305, 547–549; 401/260, 264, 259

[56] References Cited

U.S. PATENT DOCUMENTS

| | | | |
|---|---|---|---|
| 1,937,660 | 12/1933 | Luker | 91/62.6 |
| 2,294,472 | 9/1942 | MacKenzie | 12/80 |
| 2,766,136 | 10/1956 | Gray | 118/DIG. 21 |
| 3,033,160 | 5/1962 | Steidinger | 118/313 |
| 3,034,476 | 5/1962 | Didde et al. | 118/3 |
| 3,252,441 | 5/1966 | Hargreaves | 118/2 |
| 3,298,353 | 1/1967 | Huffman | 118/411 |
| 3,476,631 | 11/1969 | Huffman | 156/291 |
| 3,697,061 | 10/1972 | Levine et al. | 270/5 |
| 3,707,773 | 1/1973 | Wolfberg et al. | 34/1 |
| 3,727,576 | 4/1973 | Schriber | 118/211 |
| 3,812,820 | 5/1974 | Ronneberg | 118/3 |
| 3,815,822 | 6/1974 | Davies et al. | 239/125 |
| 3,871,280 | 3/1975 | Glaser | 118/412 |

OTHER PUBLICATIONS

Pacon Line Gluer Brochure, Printed by Pacon Machines Corporation and Dated Feb. 15, 1972.

Baldwin Technology Corporation Brochure for "Micro-Set Model 450"Press Pasting and Softening System.

*Primary Examiner*—A. J. Heinz

*Attorney, Agent, or Firm*—Biebel, French & Nauman

[57] ABSTRACT

An improved glue application system is used in combination with a collating apparatus of the type in which a plurality of rolls are mounted on spaced spindles and webs unwound from the spindles are to be collected in overlapping relation. The improved glue application system includes at least one flexible tapered nozzle having a tubular body and a tip having an end which contacts a supported surface of a selected web at an angle normal to the supported surface, the nozzle being mounted on the collating apparatus such that the tubular body flexes in response to variations in distance from the supported surface to the tubular body so that the end remains in contact with the supported web during operation of the apparatus. The nozzle communicates with a source of glue by a conduit which carries a valve which can be remotely controlled to start or stop the flow of glue through the nozzle.

23 Claims, 12 Drawing Figures

GLUE APPLICATION SYSTEM FOR A COLLATING MACHINE

BACKGROUND OF THE INVENTION

1. Field of the Invention

The present invention relates to glue applicators for collating machines, and more particularly, to glue applicators utilizing glue nozzles which contact the moving web. 2. Prior Art Collating machines, such as that disclosed in U.S. Pat. No. 3,682,468 which issued to the assignee of the present invention, are used to fabricate paper forms comprising a plurality of sheets which are glued together, typically at their longitudinal edges. Such collating machines typically include horizontally spaced spindles on which are mounted paper supply rolls and feed cylinders around which the webs from the paper supply rolls are threaded to be collected in overlapping relation along a horizontal path, typically a pin conveyor. Those feed cylinders located adjacent the horizontal path include peripherally spaced, outwardly projecting, retractable pins which engage longitudinally spaced marginal perforations within the webs to assure registration and positive feeding of the assembled webs along the path. These cylinders are often called "pin cylinders". In other collating machines, pin cylinders are not used. Instead, pinless back-up rolls are used, but those collators still employ pin conveyors to transport the web.

Collating machines also include glue systems the basic elements of which consist of one or more glue nozzles, a source of glue under pressure, and a supply line connecting the nozzles with a source of glue and including a valve which can be opened and closed to start and stop the flow of glue through each nozzle. Each nozzle is directed toward a moving web at a location prior to its engaging a second moving web so that glue may be applied prior to the overlapping of the webs.

Prior art glue systems are, in general, of two basic types: those utilizing nozzles touching the moving web to which glue is applied, and those utilizing noncontacting nozzles, in which the glue nozzle is spaced slightly away from the moving web and the glue traverses a slight air gap before it contacts the moving web. With either system it is desirable to employ a glue nozzle with a small diameter orifice, typically the size of a hypodermic needle, to provide a thin, continuous glue line of uniform width. This line must be consistent in quality to allow high speed collating without glue build-up and tenting of folded forms. The two systems have different advantages and disadvantages.

Advantages of glue systems utilizing noncontacting nozzles are: (a) the glue nozzle does not create drag upon the web, (b) the lack of contact between the nozzle and the web eliminates nozzle wear problems caused by the abrasion of the web against the tip of the nozzle, (increasing nozzle life) and (c) presence of an air gap between the tip of the nozzle and the surface of the moving web can accommodate variations in the distance between the surface of the web and the tip of the noncontacting nozzle. To maintain close spacing between the tip of the noncontacting nozzle and the moving web, noncontacting nozzles are usually positioned on the collating machine to deposit glue on a supported area of a web, as where the web passes over a pin cylinder or back-up roll.

Disadvantages of noncontacting nozzles result from the necessity of the glue having to traverse the air gap before contacting the moving web. Since the glue is not restrained by the nozzle orifice as it contacts the web, the resultant glue line may vary in width and in thickness, and if the flow rate of glue does not match the web speed at a given instant, portions of the deposited glue line may contain an excessive or an insufficient amount of glue. Adjustment of the air gap is critical, and the maintaining of a proper air gap may result in excessive down time. The maximum speed a collator may reach may be reduced, due to the inherent sensitivity of this type of nozzle.

Glue systems utilizing a contacting nozzle can more easily produce a glue line on a moving web that is consistent in width and thickness. The glue flows through the tip of the nozzle onto the paper in a thin film, constrained by the dimensions of the orifice of the nozzle. The viscosity of the glue causes the glue which has contacted the paper to draw glue from the nozzle at a rate that equals the speed of the web, thereby reducing inconsistencies in glue flow rate.

However, contacting nozzles cause drag on a moving web which can disrupt feeding of the web through the collating machine, and may cause weaving of the web and/or glue line. A wear factor is introduced since the moving web can abrade the nozzle tip, and it is necessary to make contacting nozzles of abrasion-resistant materials, such as metal, to prolong the useful life of a nozzle. But metal nozzles tend to have high spring rates and low flexibility, thus decreasing the capability of the glue nozzle to compensate for variations in the distance of the web surface from the body of the nozzle. In addition, contacting nozzle systems require high system pressures which tax the individual components, such as pumps, valves, and fittings, leading to low reliability and flow control problems.

To eliminate these disadvantages, contacting type glue nozzles are usually positioned such that glue is applied to a moving web as it passes between two cylinders and is relatively unsupported. The flexibility of this space of web serves to compensate for variations in tautness, which causes flutters of the web. Another means of compensating for the inflexibility of noncontacting nozzles is to fix a brush in contact with the moving web opposite the glue nozzle, to provide a flexible support for the web and accommodate web flutter. In addition, positioning of the nozzle and brush requires precise adjustment and the maximum speed at which a collator may function effectively is reduced if a brush and nozzle combination is used. Neither arrangement enhances the consistency or quality of the glue line, nor facilitates feeding paper through the collator.

In both contacting and noncontacting nozzle systems, high system pressure causes glue to seep through the nozzle after the machine has stopped and the line pressure has returned to atmospheric. If the web is no longer in motion, this causes a large deposit of glue to be made on the web which may render that portion of the web useless and foul the mechanical parts of the collator.

Accordingly, a need exists for a glue system which can apply a consistent line of glue to a moving web with a quality comparable to that of glue systems utilizing contacting nozzles, yet can easily compensate for variations in distance between the web and nozzle body, has a low drag factor on the web comparable to that of systems utilizing noncontacting nozzles, and which terminates flow at the nozzle tip when the flow of glue through the supply conduit is stopped. Such a system must be quick and easy to set up, result in high quality forms free of glue build-up and tenting, and be capable of high speed operation.

SUMMARY OF THE INVENTION

The present invention is directed to an improved glue application system for a collating machine, utilizing contacting nozzles that minimize the disadvantages of prior art contacting nozzles yet retain the capability of producing a thin, uniform glue line on a moving web. This system also includes an apparatus for retracting the nozzles from the web when operation of the collating machine is interrupted or completed to facilitate working in the area of the nozzle and control valves.

The glue application system of the invention is designed to be used in combination with a collating apparatus of the type having a plurality of rolls of paper mounted on spaced spindles, pin cylinders or back-up rolls to direct webs from the rolls to be collected in overlapping relation, and a drive train to rotate the pin cylinders and the rolls in unison. The system includes a flexible glue nozzle, a reservoir of glue, a conduit connecting the reservoir to the nozzle, a pump to force the glue from the reservoir to the nozzle, a valve to regulate the flow of glue from the reservoir to the nozzle, and hardware to move the nozzles to a predetermined "off" position.

The nozzle is of the contacting variety and is rigidly mounted to a wall of the collating apparatus and positioned so that its tip contacts the moving web as it passes over a supported surface, preferably a back-up roll. The nozzle is improved over prior art nozzles in that it is made from a flexible material having a low spring constant and has a tubular-tapered body that narrows gradually toward its tip which contacts the web. A glue nozzle of this type is able to apply a line of glue directly onto a supported web surface so that movement of the paper toward or away from the nozzle tip is minimized thereby enhancing the quality of the glue line. In addition, elimination of an air gap between the nozzle and the paper reduces the criticality of the nozzle placement, thus facilitating set up.

It is important that the nozzle be sufficiently flexible so that it can flow variations in the paper thickness as well as variations in the position of the web caused by the rotation of the back-up roll about an axis slightly off-center from its central axis and flutter of the web. The natural frequency of the nozzle must be considerably higher than the rotational frequency of the back-up roll as it rotates about its central axis. If the natural frequency of the nozzle approaches the rotational frequency of the back-up roll the resulting driving frequency of the back-up roll will cause the glue nozzle to bounce and create an erratic and inconsistent glue line.

At the same time, the spring constant of the glue nozzle must be low so that the drag force is minimized throughout the entire range of deflection of the glue nozzle. Since the natural frequency of the glue nozzle is directly proportional to the square root spring constant and inversely proportional to the square root of the mass of the nozzle, the desired glue nozzle must have a nozzle of very slight mass. Thus, massive glue nozzles mounted on a spring or other resilient arrangements are undesirable. For this reason, the preferred glue nozzle is made of a flexible elastomer such as polyurethane.

However, a nozzle made of a resilient elastomer would possess bad wear characteristics and would be quickly worn down by the abrasiveness of the moving web, despite the slight drag. In the preferred embodiment, the nozzle consists of the flexible, plastic tube which has a metal tip mounted in its end. The metal tip preferably is similar to a section of a hypodermic needle of approximately 19 gauge (approximately 0.070 cm I.D.). It is also preferable to bevel the end of the tip; that is, to cut the end of the tip at an angle to the central longitudinal axis of the nozzle. Thus, when the nozzle is mounted at an angle to the point of contact of the web on the pin cylinder, the beveled end will be substantially parallel to the web at the point of tangency. By maintaining the beveled end parallel to the moving web, the end can direct the glue to promote a smooth line of uniform thickness.

It is desirable to have a glue line which is not only thin in height but thin in width as well. The fact that the nozzle of the present invention contacts the web insures a glue line having a minimal height with little build-up or tenting. The width of the glue line is determined by the width of the orifice opening. Use of an inserted metal tip made of 19 gauge hypodermic needle will be sufficiently narrow in diameter to produce a line of the desired width. However, the conduit connecting the nozzle with the glue reservior must be larger in diameter, preferably $\frac{1}{4}$ inch (0.735 cm) inside diameter, to reduce the friction of the glue against the conduit so that the operating pressure required to convey glue from the reservoir to the tip is within the range of conventional pumps.

There exists a problem in necking down from a conduit of $\frac{1}{4}$ inch inside diameter to a 19 gauge hypodermic needle opening in that a sudden change in diameter of this magnitude would cause great resistance in glue flow and would require operating pressures of approximately 110 p.s.i. (7.73 kg/cm$^2$) to provide a sufficient glue flow rate during operation. The glue nozzle of the present invention eliminates this problem by utilizing a body which gradually tapers from the connection of the conduit to the modified hypodermic needle tip. The pressure required to provide a sufficient glue flow rate is thereby reduced to approximately 20 p.s.i. (1.4 kg/cm$^2$), which is well within the range of standard pumps. Thus, component reliability is greatly enhanced.

Other nozzle embodiments may be implemented, provided they possess the requisite flexibility, low mass, hard tip, and smoothness of an interior passage. For example, the nozzle body may be made of a single-piece, abrasion resistant material such as nylon. The body would have thin walls to insure proper spring constant and include a beveled tip.

In another form, the nozzle may be a single-piece thin walled tube made of metal. The tube has opposing flat sides which extend along its length and necks down to a narrow tip. The flat sides give increased flexibility to the body to enable it to ride against a web and back-up roll.

Another variation of nozzle body consists of a relatively short conical tubular body having a relatively long tip press-fitted into a narrow end. The long tip resembles a hypodermic needle and has a beveled end. The long needle provides the requisite flexibility of the nozzle.

An alternate embodiment of the nozzle may consist of a single-piece body having a generally tubular shape conveying to a narrow tip. The body includes a crimped section in which the walls have a bellows-type configuration which adds flexibility to the nozzle. This embodiment preferably is made by electroforming a metal such as nickel.

The valve of the glue system of the present invention may be a three-way valve or two two-way valves operated simultaneously so that glue may be directed to a return conduit and flow back to the reservoir when the glue nozzles are not in use. However, when the valve or valves are activated to direct the flow of glue back to the reservoir, the glue between the valve and the tip of the nozzle continues to flow through the tip of the nozzle. The glue is somewhat compressible, and, when the system pressure is reduced to atmospheric in that section of conduit, the glue expands back to its original volume with the excess running out the nozzle.

The system of the present invention provides a means to eliminate this flow of glue through the tip of the nozzle after the collating process is completed. The means includes the use of a three-way valve having "suck-back" capabilities; that is, when the valve is activated to direct the flow of glue from the nozzle back to the reservoir, there is a vacuum created within the valve that causes the glue between the valve and the tip of the nozzle to be drawn back toward the valve body. If two two-way valves are utilized the valve immediately upstream of the nozzle should have the suck-back capability.

To facilitate webbing of the paper, general housekeeping and cleaning of the collator, and adjusting the various components of the collator and glue system, the invention includes a positioning mechanism which carries the nozzles and tilts them away from the back-up rolls and web so that the tips of the nozzles point upward. The positioning mechanism preferably includes mounting brackets which hold the nozzles at a desired angle to their respective back-up rolls, and collars which receive the mounting brackets and are slidably positionable along rods positioned parallel to the back-up rolls. The rods are rotatably journalled through the ends of arms whose other ends are rotatably journalled into a wall of the collating apparatus by pins. The pins extend through the wall and are fitted to the ends of second arms which are connected at their other ends by a linkage to the rod of a pneumatic cylinder. In this fashion, extension or retraction of the cylinder rod causes the first and second arms to rotate about their pins mounted in the wall thereby causing the rods carrying the nozzles to rotate toward or away from their respective back-up rolls.

To increase the rotation of each nozzle so that its tip points in an upward direction, the corresponding rod which is rotatably journalled into an end of the arm extends through the arm and is fitted to an end of a lever. The other end of the lever contains a longitudinal slot which fits over a dowel extending outwardly from the wall of the collating apparatus. Thus, as the arm moves the rod away from the cylinder, the lever is rotated about the dowel and causes the rod to rotate with respect to the arm so that the nozzle points upward.

The preferred embodiment of the glue system includes a mechanism to regulate the flow of glue through the conduit so that glue flows through the tips of the nozzles only when the drive train of the collating apparatus is propelling the webs through the apparatus. The valves which regulate the flow of glue from the reservoir and pump of the preferred embodiment to each nozzle consists of two air-piloted two-way valves: a first valve that is normally closed which connects the conduit to the nozzle, and a second valve which is normally open that connects the conduit to a return line to the reservoir. Both valves are controlled by a single air line which, if pressurized, causes the first valve to open and the second valve to close so that glue flows from the reservoir to the nozzle. Conversely, if the air line is depressurized, the first valve returns to its normally closed position and the second to its normally open position so that glue flows from the reservoir to the return line and back to the reservoir.

The mechanism includes a solenoid in the air line to the valves which is activated by an electrical signal from an optical encoder of a type well-known in the art. The encoder consists of a glass disk rotationally driven by the drive train of the collator. A light source is directed through a series of transparent and opaque portions on the disk to a phototransistor forming part of the optical encoder. When the drive train of the collating apparatus is activated to cause the webs to move through the collating machine, the glass disk rotates to allow pulses of light to hit the photodetector. The encoder generates a signal in the form of electrical pulses in response to the light pulses which is sent to a control circuit. The control circuit causes the solenoid to be positioned to pressurize the air line to the valves, permitting the glue to flow through the nozzle. It is preferable to utilize air-piloted valves with suck-back capability.

Accordingly, it is an object of the present invention to provide a glue system for use in combination with a collating apparatus which utilizes a flexible contacting-type nozzle that results in a low system pressure, produces a uniform glue line and compensates for eccentricities in the rotation of the adjacent back-up roll, web flutter, and variations in thickness of the moving web, a glue system utilizing a contacting-type nozzle that is inexpensive yet wear-resistant and can be changed easily, a glue system utilizing a nozzle that can be retracted from the adjacent pin cylinder such that the tip is elevated above the body, a glue system utilizing a tapered nozzle to reduce pressure losses, and a glue system that can be set up easily and retain its setting.

These and other objects of the invention will become apparent from the following description, the attached drawings, and the appended claims.

DETAILED DESCRIPTION OF THE PREFERRED EMBODIMENT

Figure 1:
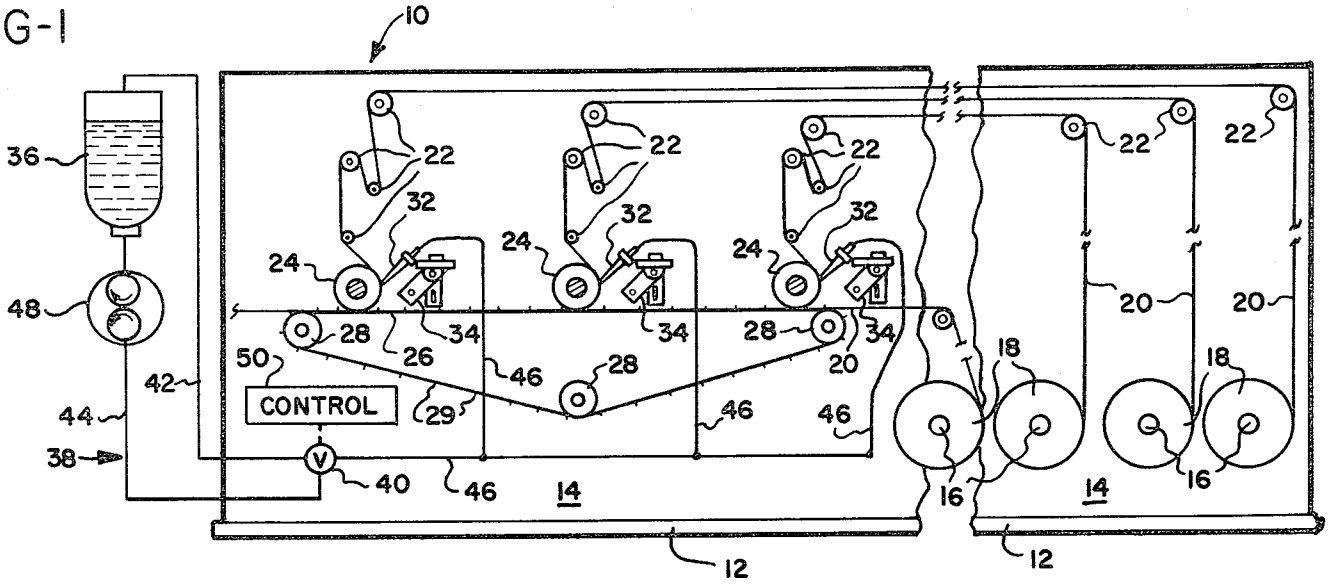
FIG. 1 is a somewhat schematic side elevation of a typical collator incorporating the glue system of the present invention.

As shown in FIG. 1, the glue application system of the present invention can be integrated with a collating apparatus, generally designated 10. A typical collating apparatus 10 is more fully described in U.S. Pat. No. 3,682,468 which is issued to the assignee of the present invention. However, it should be understood the invention is also applicable to other types of apparatus having a collating function. The collating apparatus 10 includes an elongated base 12 from which extends a vertical frame or wall 14. A series of horizontally arranged parallel spindles 16 are supported and extend outwardly from the wall 14 for free rotation and receive corresponding rolls 18 of paper webs 20, each having longitudinally spaced marginal perforations or feed holes. It is understood that the web 20 may also be a carbon tissue web. Typically, the paper webs 20 are directed by a series of rotatable spindles 22 to corresponding back-up rolls 24. The back-up rolls are positioned above an endless pin conveyor 26 which is carried by pulleys 28. The pin conveyor 26 is fitted with a series of protrusions or pins 29 spaced apart to matingly engage the feed holes of the paper web 20. The rotatable spindles 22, back-up rolls 24, and pulleys 28 are cantilevered outwardly from the wall 14 of the collating apparatus 10. Movement of the pin conveyor 26 and back-up rolls 24 causes the paper webs 20 to move along the pin conveyor and become collected in overlapping relationship as the collated form progresses through the collating apparatus 10.

The glue application system of the present invention includes a series of nozzles 32 mounted on positioning means 34 which is mounted to wall 14. The nozzles 32 communicate with a source of glue such as a reservoir 36 by a conduit 38. The conduit 38 carries a valve means which can be a three-way valve 40. The valve 40 also communicates with the reservoir 36 by way of a return line 42. The conduit 38 includes a supply line 44 which runs from the reservoir 36 to the valve 40, and a feed line 46 which extends from the valve to the nozzles 32. In order to pump the glue through the conduit 38, a pump such as a gear pump 48 is positioned on the supply line 44. The valve 40 includes a control 50 which may be an air-piloted solenoid of a type well-known in the art.

Figure 2:
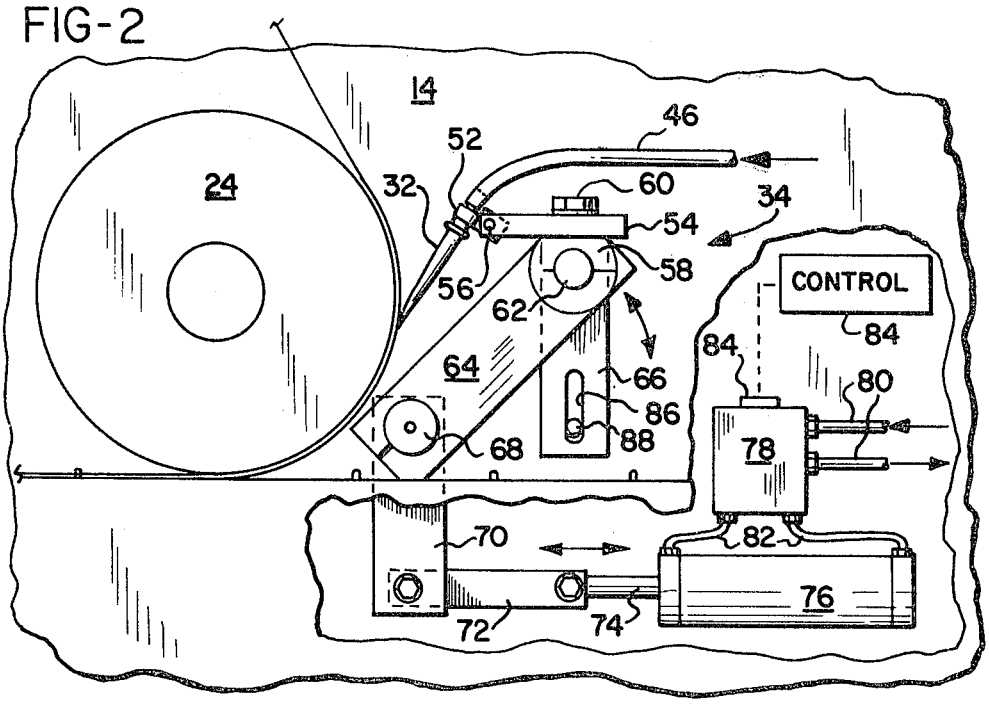
FIG. 2 is a partial side elevation of a glue nozzle against a pin cylinder on the collator of FIG. 1 broken away to show the positioning mechanism.
Figure 3:
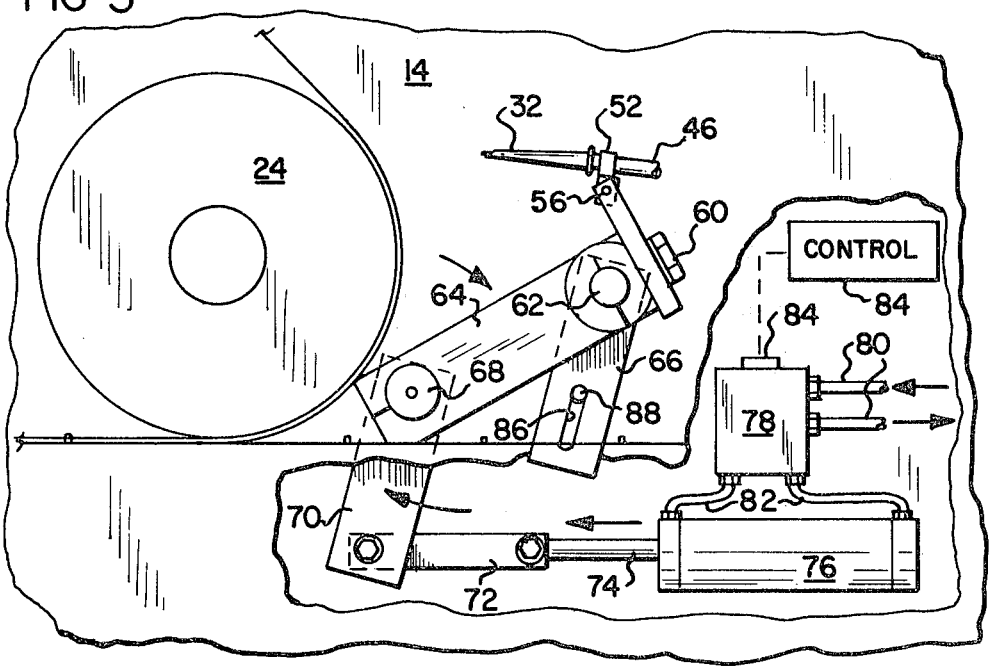
FIG. 3 is the view of FIG. 2 with the positioning mechanism adjusted so that the glue nozzle is retracted from the pin cylinder.

As shown in FIGS. 2 and 3, a nozzle 32 is joined to a feed line 46 by a mounting bracket 52. The mounting bracket 52 is joined to a support bar 54 by a bolt 56 which allows the mounting bracket and nozzle 32 to be positioned at different angles to the support bar. The support bar 54 is held to a collar 58 by a bolt 60. It is preferable to have a longitudinal slot (not shown) formed in the support bar 54 so that the bolt 60 may pass through the slot at different positions to allow the support bar to be adjusted relative to the collar 58. The collar 58 is fitted over a rod 62 which is substantially parallel to the axis of rotation of the adjacent pin cylinder 24 thereby allowing movement of the nozzle 32 in a plane parallel to the axis of the back-up roll 24. The collar 58 is adjustably mounted to the rod 62 and can be positioned to accommodate webs of varying widths.

The rod 62 passes through an end of an arm 64 and is rigidly mounted in an end of a lever 66 adjacent the end of the arm on a side opposite the collar 58. The opposite end of the arm 64 has an opening which holds a pin 68 which passes through the wall 14 of the collating apparatus 10. On the opposite side of the wall 14 the pin is rigidly mounted to an end of a second arm 70. Second arm 70 is connectd by a linkage 72 to the rod 74 of a double-acting cylinder 76 which is preferably pneumatically operated. The double-acting cylinder 76 is operated by a solenoid 78 which directs compressed air from supply lines 80 to the cylinder by way of lines 82. The solenoid 78 is preferably an electrical solenoid which can be remotely operated by a control 84 which preferably is integrated with the electrical controls of the entire collating apparatus 10 in a manner well-known in the art.

The lever 66 has a longitudinal slot 86 formed in an opposite end to the end receiving the rod 62. The slot 86 is fitted over a dowel 88 which preferably is press fitted into the wall 14. The slot 86 is sized so that the lever 66 may move relative to the dowel which slides along the slot.

In FIG. 3, the positioning means 34 is shown in a retracted position in which the nozzle 32 has been displaced away from pin cylinder 24. To retract the nozzle 34 from pin cylinder 24, the control 84 activates solenoid 78 which permits compressed air to flow through lines 82 so that rod 74 extends from cylinder 76. Extension of rod 74 pushes second arm 70 by means of linkage 72 and cause the second arm to rotate pin 68 which is journalled within wall 14. The rotation of pin 68 causes arm 64 to rotate about the axis of the pin and draw the nozzle 32 away from pin cylinder 24.

At the same time, movement of arm 64 causes lever 66 to rotate about dowel 88. Since the distance from dowel 88 to rod 62 is less than the distance from the rod to the pin 68, rotation of arm 64 causes lever 66 to rotate to a greater extent than the arm thereby causing the rod to rotate relative to the arm. In this fashion, the nozzle 32 is rotated so that its end points upward to a greater degree than if the rod was rigidly mounted to the arm 64.

Figure 4:
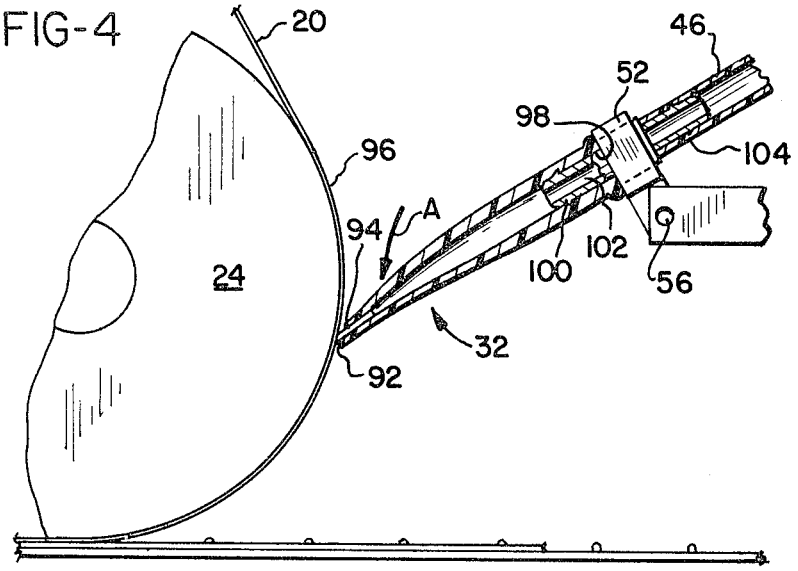
FIG. 4 is a side elevation of a glue nozzle of the invention in section flexing against a pin cylinder.
Figure 5:
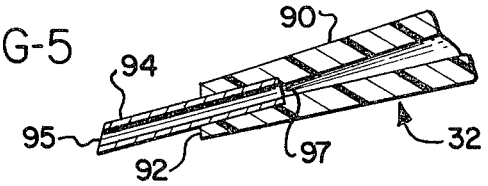
FIG. 5 is a partial side elevation, in section, of the glue nozzle of FIG. 4.

The nozzle design is shown most clearly in FIGS. 4 and 5. A typical nozzle 32 consists of a tapered tubular body 90 and a beveled end 92. The body 90 is molded to include a recess 93 in its end sized to receive a hollow, cylindrical tip 94 having a beveled end 95 which contacts the surface 96 of a paper web 20 as the paper web passes over a pin cylinder 24. The surface 96 is considered a "supported surface" in that it is supported by the pin cylinder 24 and does not move substantially with respect to the tip 94 of the nozzle 32. The recess 93 is shaped to receive the body 90 so that there is a smooth transition from the inside wall of the body to the opening 97 in the tip 94. The tip 94 is cemented to the recess 93 by a suitable adhesive.

At the opposite end of the nozzle 32 is a mouth 98 which fits over a tube 100 which is integral with mounting bracket 52 and forms a passage 102 extending through the mounting bracket and a second tube 104 on an opposite side of the mounting bracket. The second tube 104 is sized to receive an end of a feed line 46 of conduit 38 (as shown in FIG. 1). Both the mouth 98 of nozzle 32 and the feed line 46 are held to tubes 100 and 104, respectively, by means of the elastic properties of the nozzle end supply line materials. However, if desirable, a suitable clamp (not shown) may be employed to fit over the nozzle mouth 98 and feed line 46 to prevent slipping with respect to the tubes 100, 104.

The nozzle 32 preferably is made from a flexible material such as polyurethane or other elastomer. The tip 94 is made of an abrasion resistant material such as stainless steel, nickel alloys, or brass and is approximately the same size as an 19 gauge hypodermic needle.

As shown in FIG. 4, the nozzle 32 is positioned adjacent the surface 96 of the moving web 20 so that the tapered body 90 is deflected slightly when the tip 94 contacts the surface 96 in the direction of the arrow "A". Thus, as the back-up roll 24 rotates during the collating operation, the tip 94 is held in contact with the surface 96 of the moving web 20 at all times by the resiliency of the tapered body 90. It is preferable that the tapered body 90 and tip 94 have a small combined mass and a small spring constant so that the tip can track the surface 96 with a minimum of pressure which reduces drag on the web 20 and substantially reduces the chance of tearing the web or creating a condition of imbalance.

Figure 6:
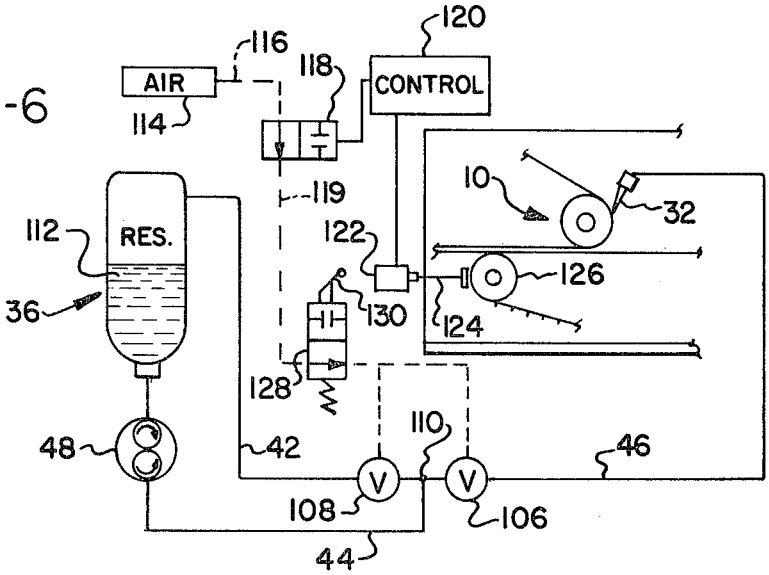
FIG. 6 is a somewhat schematic view of the glue system of the preferred embodiment.

As shown in FIG. 6, the preferred embodiment of the glue application system includes a means for controlling the flow of glue from a reservoir 36 to the nozzle 32 so that glue is supplied to the nozzle under pressure only when the collating apparatus 10 is operating. Preferably, the valve means includes a first two-way valve 106, a second two-way valve 108, and a three-way connection 110. The first valve 106 is a normally closed air-piloted valve and controls the flow of glue from the supply line 44 to the feed line 46 and the nozzle 32. The second valve 108 is a normally open air-piloted valve and controls the flow of glue from the supply line 44 to the return line 42 and back to the reservoir 36 which is partially filled with a water-based glue 112.

The air-piloted valves 106, 108 are activated by a source of compressed air 114 which communicates with the valves by means of an air line 116. A solenoid valve 118 is mounted on the air line 116 and is of the type having an "on" position and an "off" position so that the air line 119 to the valves 106, 108 is alternately pressurized and depressurized. The solenoid valve 118 is electrically operated and is activated by control circuitry 120. circuitry 120, and the control operates to close solenoid valve 118 thereby depressurizing air line 116. The depressurization of air line 116 allows the first valve 106 to resume its normally closed mode and the second valve 108 to resume its normally open mode, thus permitting glue to flow through the return line 42 and back to the reservoir.

Figure 7:
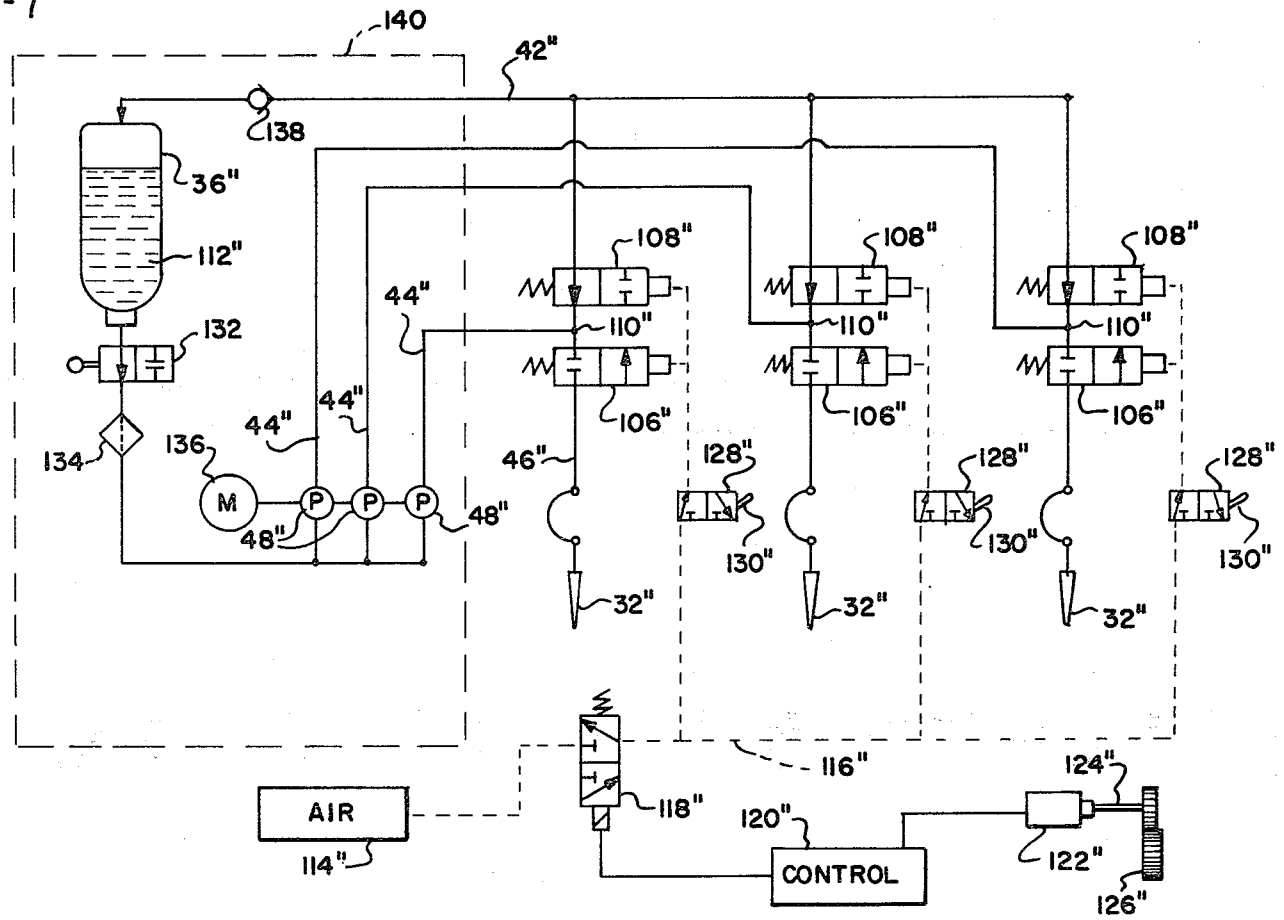
FIG. 7 is a schematic diagram of the glue supply system of the preferred embodiment.

As shown in FIG. 7, the system of the preferred embodiment can be implemented in a collating apparatus having a number of nozzles 32". Glue 112" from reservoir 36" flows through a valve 132 and filter 134 to gear pumps 48" driven by motor 136. Pumps 48" develop a sufficient pressure head to pump glue through its respective supply line 44". It should be noted that, although FIG. 7 depicts a system utilizing three nozzles 32", this system can be expanded to accommodate any desired number of glue nozzles.

Each supply line 44" communicates with a three-way connection 110" which, in turn, communicates with the inlet port of a first normally closed two-way valve 106" and a second normally open two-way valve 108". The normally closed valve 106" communicates with nozzle 32" by feed line 46". The second normally open valve 108" communicates with reservoir 112" by a common return line 42". A check valve 138 may be included which has a resealing pressure slightly above zero to hold a residual pressure in the lines, thereby urging the glue to flow at start up before the pumps have built up full operating pressure.

As shown by broken line 140, the reservoir 112", filter 132, valve 134, pump 48", motor 136, and check valve 138, may be packaged as a single unit which can readily be connected to supply lines 44" and return lines 42".

The valves 106", 108" are air-piloted valves operated by air line 116" which communicates with a source 114" of compressed air, similar to the configuration of FIG. 6. Second solenoid valves 128" can be positioned by an operator to activate selected nozzles 32" in accordance with the specific type of collating process to be performed.

By placing the solenoid valve 118" at a common portion of air line 116", all nozzles in the system shown in FIG. 7 can be turned on or off simultaneously by control circuitry 120", upon the appropriate signal from encoder 122".

Although the two-way valves or the three-way valves of the previously discussed embodiments may be a standard type used for applications involving the use of water-based glue, it is preferred to employ valves upstream of the nozzles having "suck-back" capabilities; that is, upon the closing of the valve a slight vacuum is created to draw the glue in the line downstream of the valve back toward the valve. This suck-back capability will prevent excessive glue from flowing out of the tip of the nozzle after the glue application step of the collating process is completed.

FIGS. 8, 9, 10, and 11 show alternate nozzle embodiments. Those reference numerals used in the figures greater than 200 correspond to those used to describe the preferred embodiment discussed previously. Each of those reference numerals used in describing the embodiments comprises three digits, the last two of which correspond to the reference numeral used to denote the corresponding portion of the previously discussed preferred embodiment. Additional elements with no counterpart in the preferred embodiment are given reference numerals less than 200.

Figure 8:
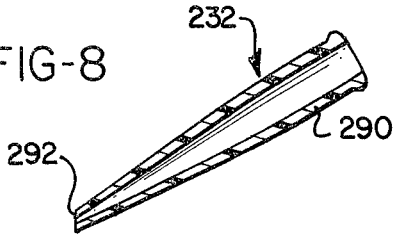
FIG. 8 is an alternate embodiment of a nozzle of the present invention, in section.

As shown in FIG. 8, an alternate embodiment of a nozzle 232 consists only of a single-piece body 290 made of a flexible, abrasion resistant material such as nylon. In such an embodiment, the beveled end 292 would contact a surface of a moving web in the same manner as the nozzle 32 shown in FIG. 4. Such a nozzle 232 would have to have thinner walls to insure an appropriate spring constant and mass to minimize drag on the surface of the moving web.

Figure 9:
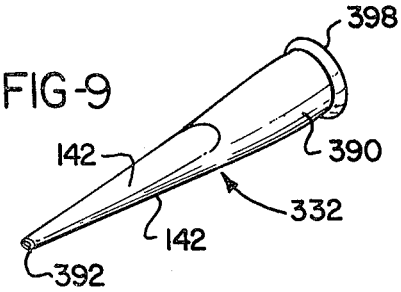
FIG. 9 is an alternate embodiment of a nozzle of the present invention.

As shown in FIG. 9, a nozzle 332 has a body 390 which is relatively thin-walled and made of metal. The body 390 is circular in shape at its mouth 398 so that it may be inserted over a tube which is integral with a mounting bracket. The cross sectional shape of the body 390 is circular at its mouth 398 and becomes flattened as it extends toward its beveled end 392. The width of the nozzle 332 decreases toward the tip 392, giving an overall "duck bill" shape to the nozzle. Thus, the nozzle shown in FIG. 9 can be distinguished from the nozzles previously discussed in that the body 390 includes opposing flat surfaces 142. These flat surfaces 142 give flexibility to the nozzle 332 so that it may ride against a web and back-up roll.

Figure 10:
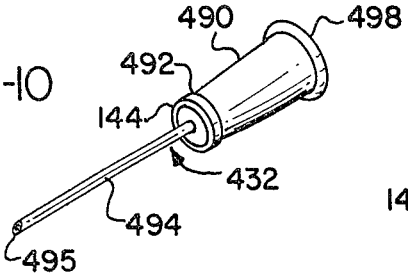
FIG. 10 is an alternate embodiment of a nozzle of the present invention.
Figure 10A:
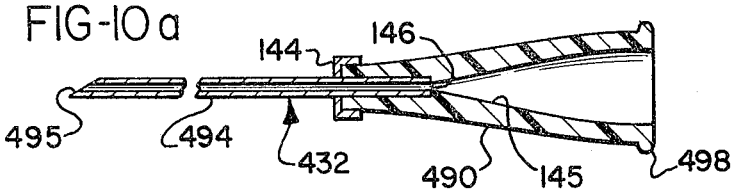
FIG. 10*a* is a side elevation, in section, of the nozzle of FIG. 10.

As shown in FIGS. 10 and 10*a*, a nozzle 432 may have a relatively short body 490 having a mouth 498 sized to fit over a tube on a mounting bracket. The nozzle 432 includes an elongated tip 494, resembling a hypodermic needle, which attaches to the end 492 of the body 490. The tip 494 terminates in a beveled end 495 which is shaped to lie flat against a moving web.

The nozzle 432 is distinguishable from previously discussed nozzles in that the tip 494 includes a cup 144 for receiving the end 492 of the body 490. The tip 494 may be attached to the body 490 by a press fit so that there is a smooth transition between the walls 145 of tapered base and the mouth 146 of the tip 494.

Figure 11:
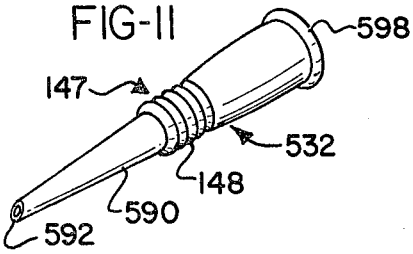
FIG. 11 is an alternate embodiment of a nozzle of the present invention.

FIG. 11 shows an additional embodiment of a nozzle 532 having a thin-walled tubular metallic body 590 which terminates in a beveled end 592. The mouth 598 of the body 590 is sized to be placed over a tube of a mounting bracket. The body 590 of the nozzle 532 is distinguishable from previously discussed nozzle embodiments in that it includes a crimped section 146 in which the wall 148 of the body has a bellows-type configuration in longitudinal cross section.

The bellows-type configuration of the crimped section 146 allows the body 590 of the nozzle 532 to have greater flexibility than if the wall 148 was merely a straight piece. Thus, the end 592 of the body 590 is better able to accommodate any variations in the distance between the mounting bracket and the supported surface of the moving web during operation. The nozzle 532 is preferably manufactured by electro-forming and a desirable material is nickel.

While the apparatus herein described constitute preferred embodiments of the invention, it is to be understood that the invention is not limited to these precise methods and forms of apparatus and that changes may be made in either without departing from the scope of the invention.

What is claimed is:

1. For use in a collating apparatus of the type in which a plurality of rolls are mounted on spaced spindles and webs unwound therefrom are collected in overlapping relation, an improved glue application system comprising:

at least one nozzle having a flexible body, a tip at one end for contacting a supported surface of a selected web at a glue application point and an opposite end for mounting to a rigid support, said body extending at an angle other than normal to the supported surface and being sufficiently flexible that said body is capable of flexing between said ends in response to variations in the distance between said application point and said opposite end;

means mounting said nozzle body for biasing said one end into contact at said glue application point so that said tip may remain in continuous contact with a supported web surface during operation of a collating apparatus;

a source of glue;

conduit means for conveying glue from said source to said nozzle; and means for controlling flow of glue through said conduit means and said nozzle.

2. The system of claim 1 wherein said tip has a beveled end such that said beveled end may be oriented substantially parallel to a supported surface at a point of contact when said nozzle is disposed nonperpendicularly to a supported surface.

3. The system of claim 2 further comprising a back-up roll for supporting a selected web, and said nozzle being positioned such that said beveled end contacts a selected web at a nonperpendicular angle as it passes about said back-up roll.

4. The system of claim 3 wherein said nozzle has a natural frequency substantially higher than a rotational frequency of said back-up roll.

5. The system of claim 1 further comprising means for rigidly mounting said nozzle to a collating apparatus.

6. The system of claim 1 wherein said body is made from an elastomeric material, said tip is made from an abrasion resistant material and said body includes an interior wall that intersects an opposite end of said tip such that there is a smooth transition therebetween.

7. The system of claim 6 wherein said interior wall tapers toward said opposite end of said tip.

8. The system of claim 7 wherein said abrasion resistant material is a metal selected from the group consisting of steel, nickel alloys, stainless steel, and brass.

9. The system of claim 1 wherein said nozzle is made of a polyurethane.

10. The system of claim 1 wherein said body tapers toward said tip and defines a pair of opposing flat surfaces extending from said tip toward a mouth.

11. The system of claim 10 wherein said tip has a beveled end and said pair of opposing flat surfaces are positioned with respect to a collating apparatus on which said nozzle is mounted such that they are normal to a plane in which said body flexes.

12. The system of claim 1 wherein said tip comprises an elongated tube having a beveled end and an opposite end terminating in a cup portion, and said body includes an end mounted within said cup means, said body having an interior wall tapering toward said opposite end of said tube such that there exists a smooth transition between said interior wall and said opposite end.

13. The system of claim 1 wherein said body includes a wall having crimped portion, said crimped portion defining a plurality of bellows-type deformations in said wall, thereby adding flexibility to said body.

14. For use in a collating apparatus of the type in which a plurality of rolls are mounted on spaced spindles and webs unwound therefrom are collected in overlapping relation, an improved glue application system comprising:

at least one nozzle having a flexible body, a tip at one end for contacting a supported surface of a selected web at a glue application point and an opposite end for mounting to a rigid support, said body extending at an angle other than normal to the supported surface and being sufficiently flexible that said body is capable of flexing between said ends in response to variations in the distance between said application point and said opposite end;

means mounting said nozzle body for biasing said one end into contact at said glue application point so that said tip may remain in continuous contact with a supported web surface during operation of a collating apparatus;

a source of glue;

conduit means for conveying glue from said source to said nozzle;

valve means located on said conduit means;

a return line extending from said valve means to said source of glue; and optical encoder means for detecting the movement of a selected web through a collating apparatus and control means responsive to said encoder means for opening said solenoid valve when said encoder means detects movement of a selected web, whereby glue flows from said source through said valve means to said nozzle, and for closing said solenoid valve when said encoder means detects cessation of movement of a selected web, whereby glue flows from said source through said valve means and through said return line back to said source.

15. The system of claim 14 wherein said valve means comprises a three-way valve and said conduit means includes a supply line extending from said source to said valve means and a feed line extending from said valve means to said nozzle.

16. The system of claim 14 wherein said valve means comprises a first and a second two-way valve, and a three-way connection joining said first and said second valves; and said conduit means includes a supply line from said source to said connection and a feed line from said first two-way valve to said nozzle, and said return line extends from said second two-way valve to said source.

17. The system of claim 16 wherein said first two-way valve is an air-piloted normally closed valve and said second valve is an air-piloted normally open valve; and said means for activating said valve means includes an air line carrying compressed air and a solenoid valve on said air line such that said solenoid valve is open for said first mode pressurizing said air line and thereby closing said second normally open valve and opening said first normally closed valve, and said solenoid valve is closed for said second mode depressurizing said air line thereby opening said normally open valve and closing said normally closed valve.

18. For use in a collating apparatus of the type in which a plurality of rolls are mounted on spaced spindles and webs unwound therefrom are collected in overlapping relation, an improved glue application system comprising:

at least one nozzle having a flexible body, a tip at one end for contacting a supported surface of a selected web at a glue application point and an opposite end for mounting to a rigid support, said body extending at an angle other than normal to the supported surface and being sufficiently flexible that said body is capable of flexing between said ends in response to variations in the distance between said application point and said opposite end;

means mounting said nozzle body for biasing said one end into contact at said glue application point so that said tip may remain in continuous contact with a supported web surface during operation of a collating apparatus;

said tip made of an abrasion resistant material selected from the group consisting of steel, nickel alloys, stainless steel, and brass;

a source of glue;

conduit means for conveying glue from said source to said nozzle; and means for controlling flow of glue through said conduit means and said nozzle.

19. In combination with a collating apparatus of the type in which a plurality of rolls are mounted on spaced spindles and webs unwound therefrom are collected in overlapping relation, and having means for guiding webs along predetermined paths and into overlapping relation, an improved glue application system comprising:

at least one nozzle having a flexible body, a tip at one end which contacts a supported surface of a selected web at a glue application point at an angle other than normal to the supported surface, said nozzle being mounted on said collating apparatus at an opposite end thereof and being sufficiently flexible such that said body flexes in response to variations in the distance between said application point and said opposite end;

means mounting said nozzle body for biasing said one end into contact at said glue application point so that said tip remains in contact with the supported surface during operation of said collating apparatus;

a source of glue;

conduit means for conveying glue from said source to said nozzle; and means for controlling the flow of glue through said conduit means and said nozzle.

20. The collating apparatus of claim 19 wherein said tip is made of an abrasion resistant material and has a beveled end oriented substantially parallel to a supported surface at a point of contact.

21. The collating apparatus of claim 20 further comprising a back-up roll for supporting a selected web, and said nozzle being positioned such that said beveled end contacts a selected web as it passes about said back-up roll.

22. The collating apparatus of claim 21 wherein said nozzle has a natural frequency substantially higher than a rotational frequency of said back-up roll.

23. For use in a collating apparatus of the type in which a plurality of rolls are mounted on spaced spindles and webs unwound therefrom are collected in overlapping relation, an improved glue application system comprising:

at least one nozzle having a flexible body made of polyurethane, a tip at one end for contacting a supported surface of a selected web at a glue application point and an opposite end for mounting to a rigid support said body extending at an angle other than normal to the supported surface and being sufficiently flexible that said body is capable of flexing between said ends in response to variations in the distance between said application point and said opposite end;

means mounting said nozzle body for biasing said one end into contact at said glue application point so that said tip may remain in continuous contact with a supported web surface during operation of a collating apparatus;

a source of glue;

conduit means for conveying glue from said source to said nozzle; and means for controlling flow of glue through said conduit means and said nozzle.

* * * * *

UNITED STATES PATENT AND TRADEMARK OFFICE

CERTIFICATE OF CORRECTION

PATENT NO. : 4,426,072

DATED : January 17, 1984

INVENTOR(S) : Cole et al.

It is certified that error appears in the above—identified patent and that said Letters Patent is hereby corrected as shown below:

Column 3, line 47, "flow" should be --follow--.

Column 4, line 5, "the" , second occurrence, should be -- a--

Column 4, line 41, "of" should be --to--.

Column 8, line 11, "connectd" should be --connected--.

Column 9, line 47, after "120.", first occurrence, insert the following:

--The control circuitry 120 includes an optical encoder 122 which is driven by a gear drive 124 from the drive train 126 of the collator 10. The encoder 122 is of a type well known in the art and contains a glass disk (not shown) which is rotated about its central axis by the gear drive 124. The disk contains a pattern of opaque and transparent portions. The encoder 122 also contains a light source and a photoreceptor (not shown) arranged so that rotation of the disk by the gear train in response to drive train movement causes pulses of light to impinge upon the photoreceptor. The photoreceptor sends electrical pulses to the control circuitry 120 which activates solenoid valve 118 to adjust its position. The control circuitry 120 is programmed to position solenoid 118 in the "on" position only when the drive train of the collating apparatus 10 is moving which occurs only when web 20 moves through the apparatus 10. Thus, the air line 116 is pressurized only during operation of the collator 10.

The air line 116 may also carry a second solenoid valve 128 which is operated manually by a toggle switch 130.

It is certified that error appears in the above—identified patent and that said Letters Patent is hereby corrected as shown below:

The second solenoid valve 128 has an "on" position and an "off" position so that different nozzles of a multiple nozzle collator can be selectively turned "on" or "off".

The operation of the glue application system of the preferred embodiment is as follows. After the rolls 18 have been mounted on the parallel spindles 16 of the collating apparatus 10, the paper webs 20 are unwound and threaded through the appropriate spindles 22 and over their respective back-up rolls 24 to be arranged in overlapping relationship on pin conveyor 26 (Fig. 1). The gear pump 48 is activated to pump glue from reservoir 36 through supply line 44 to valves 106, 108 (Fig. 6). At this time, air line 116 is not pressurized because solenoid 118 is in the "off" mode. As a result, the first two-way valve 106, which is normally closed, does not permit glue to flow through feed line 46 to nozzle 32. The second two-way valve 108, which is normally open, allows glue to flow through return line 42 and back to reservoir 112.

The positioning means 34 is presently in the retracted position as shown in Fig. 3, so that the nozzle 32 is displaced away from back-up roll 24 and its tip 94 is elevated above its body 90. When the threading process has been completed, control 84 is activated to position solenoid valve 78 to allow compressed air to flow through supply line 80 to cylinder 76 so that rod 74 is moved inwardly. This rotates arm 64 about pin 68 in the manner discussed previously so that nozzle 32 is brought into contact with the surface 96 of paper web 20, as shown in Fig. 2.

When the collating apparatus 10 is activated and the drive train begins to advance the web through the apparatus, the optical encoder 122 sends a signal to the

UNITED STATES PATENT AND TRADEMARK OFFICE

CERTIFICATE OF CORRECTION

PATENT NO. : 4,426,072

DATED : January 17, 1984

INVENTOR(S) : Cole et al.

It is certified that error appears in the above-identified patent and that said Letters Patent are hereby corrected as shown below:

control circuitry 120 which activates solenoid valve 118, placing it in the "on" position. The air line 116 is pressurized from the source of compressed air 114 which opens the normally closed first valve 106 and closes the normally open second valve 108. Glue is permitted to flow from the supply line 44 through the three-way connection 110 and first valve 106 to the nozzle 32 and onto the surface 96 of the moving web 20.

When the collating process is completed, the encoder 122 no longer sends signals to control--.

Signed and Sealed this

*Eighteenth* Day of *June 1985*

[SEAL]

*Attest:*

DONALD J. QUIGG

*Attesting Officer* *Acting Commissioner of Patents and Trademarks*